US009397399B2

(12) United States Patent
Pajona et al.

(10) Patent No.: US 9,397,399 B2
(45) Date of Patent: Jul. 19, 2016

(54) LOOP ANTENNA WITH SWITCHABLE FEEDING AND GROUNDING POINTS

(71) Applicants: Olivier Pajona, San Diego, CA (US); Laurent Desclos, San Diego, CA (US)

(72) Inventors: Olivier Pajona, San Diego, CA (US); Laurent Desclos, San Diego, CA (US)

(73) Assignee: ETHERTRONICS, INC., San Diego, CA (US)

( * ) Notice: Subject to any disclaimer, the term of this patent is extended or adjusted under 35 U.S.C. 154(b) by 456 days.

(21) Appl. No.: 13/868,093

(22) Filed: Apr. 22, 2013

(65) Prior Publication Data

US 2013/0307740 A1 Nov. 21, 2013

Related U.S. Application Data

(60) Provisional application No. 61/636,553, filed on Apr. 20, 2012.

(51) Int. Cl.

| | |
|---|---|
| ***H01Q 7/00*** | (2006.01) |
| ***H01Q 1/24*** | (2006.01) |
| ***H01Q 21/28*** | (2006.01) |
| ***H01Q 5/307*** | (2015.01) |

(52) U.S. Cl.

CPC ..... *H01Q 7/00* (2013.01); *H01Q 1/243* (2013.01); *H01Q 5/307* (2015.01); *H01Q 21/28* (2013.01)

(58) Field of Classification Search

CPC ..... H01Q 7/00; H01Q 1/243; H01Q 21/28
USPC ..... 343/748, 866, 702
See application file for complete search history.

(56) References Cited

U.S. PATENT DOCUMENTS 6,771,223 B1 * 8/2004 Shoji ..... H01Q 1/243 343/700 MS

* cited by examiner

*Primary Examiner* — Dieu H Duong
(74) *Attorney, Agent, or Firm* — Coastal Patent Law Group, P.C.

(57) ABSTRACT

An active differential antenna is described that provides for improved performance for wireless communication systems across a wide set of use cases and environments. A balanced antenna structure along with switch assembly provides the differential mode radiation which results in minimal coupling to the components and items in the near field of the antenna. This results in an efficient antenna that is well isolated from the local environment of the antenna. The switch assembly is configured to switch the feed and ground connections of the differential design when needed to provide similar antenna performance for both "against head left" and "against head right" use cases for a cellular handset application for example. An active component or circuit can be integrated or coupled to the antenna design to provide the capability to dynamically balance the antenna to maintain pattern symmetry and efficiency.

11 Claims, 17 Drawing Sheets

132

| Feed Configuration | | ECC | Isolation |
|---|---|---|---|
| Ant1/Port1 | Ant2/Port1 | E1 | I1 |
| Ant1/Port2 | Ant2/Port1 | E2 | I2 |
| Ant1/Port1 | Ant2/Port2 | E3 | I3 |
| Ant1/Port2 | Ant2/Port2 | E4 | I4 |

| Feed Configuration | | ECC | Isolation |
|---|---|---|---|
| Ant1/Port1 | Ant2/Port1 | E1 | I1 |
| Ant1/Port2 | Ant2/Port1 | E2 | I2 |
| Ant1/Port1 | Ant2/Port2 | E3 | I3 |
| Ant1/Port2 | Ant2/Port2 | E4 | I4 |
| Active component 1 | tuning state 1 | E5 | I5 |
| .... | tuning state 2 | .... | .... |
| .... | .... | .... | .... |
| .... | .... | .... | .... |
| Active component 2 | tuning state 1 | .... | .... |
| .... | tuning state 2 | .... | .... |
| .... | .... | .... | .... |
| .... | .... | .... | .... |

146

LOOP ANTENNA WITH SWITCHABLE FEEDING AND GROUNDING POINTS

CROSS-REFERENCE TO RELATED APPLICATIONS

This application claims benefit of priority with U.S. Provisional Ser. No. 61/636,553, filed Apr. 20, 2012, titled "LOOP ANTENNA WITH SWITCHABLE FEEDING AND GROUNDING POINTS"; the contents of which are hereby incorporated by reference.

BACKGROUND OF THE INVENTION

1. Field of the Invention

The present invention relates generally to the field of wireless communication. In particular, this invention relates to an active differential mode loop antenna configured to maintain efficient operation across a wide set of use cases for use in wireless communications.

2. Description of the Related Art

The availability of wireless services, such as Global System for Mobile Communications (GSM), Radio Frequency Identification (RFID), Distributed Control System (DCS), Personal Communications Service (PCS), UW, Digital Video Broadcasting-Terrestrial/Handheld (DVB-T/H), Wireless Fidelity (Wifi), Bt, Worldwide Interoperability for Microwave Access (Wimax), Long Term Evolution (LTE), Global Positioning System (GPS), and others, supported by modern handsets, such as MP3 player, mobile phone, laptop, video gaming devices, tablets, and the like have increased significantly during the last decade.

The Numbers of antennas in each device is increasing as well as the number of available wireless services and therefore, the embedded antennas need to be small and require high performance. Modern communication devices such as cellphones typically contain four or five antennas, with each antenna serving a specific function and frequency band. These antennas are closely spaced and are volume constrained, and good isolation between the antennas is needed for efficient operation.

With cellular communication systems becoming more loaded and capacity constrained, the antenna systems on the mobile side of the communication link are expected to become more efficient to assist in maintaining a level of acceptable network performance. Under-performing mobile devices in regard to the radiated performance of the device will degrade the cellular network, with these under-performing devices requiring more system resources compared to more efficient mobile devices.

Several solutions have been proposed over the years to improve the Total Radiated Power (TRP) and Total Isotropic Sensitivity (TIS) performance of the cellular antenna or to fulfill Specific Absorption Rate (SAR) and Hearing Aid Compatibility (HAC) requirements. Though various antenna techniques and topologies have been proposed and developed to improve antenna efficiency for internal applications, they all suffer from the limitation of being optimized for a single use case such as device in user's hand, device against the user's head, or device in free space environment. To improve on this situation, an antenna can be designed to provide a compromise solution, where the performance of the antenna is considered for a multitude of use cases and is not optimized for a preferred use case.

One antenna structure, called a folded loop antenna, has demonstrated several advantages for handset applications. It can be designed to have several resonances, with one resonance to cover low band cellular frequencies (<1 GHz) and one or multiple resonances to cover high band cellular frequencies (1.5 GHz to 10 GHz bands) when applied to cellular applications. One important benefit of this antenna structure is that one of the different resonances of the folded loop antenna located in the high band (1710 MHZ to 2170 MHZ) is generated from a differential mode (also referred as a balanced mode). The advantages of this differential mode, are lower losses from the head when the phone is in "beside head" position, lower HAC and SAR values.

The differential mode existence is however tightly related to the symmetry of the way the antenna's E and H field are coupling with the mechanics of the host device. A symmetrical radiator design is required to generate the symmetrical coupling, which can be achieved during the antenna design process, but the non-symmetrical mechanical features of the host device will degrade the differential mode. Typically the non-symmetry of the mechanics of the host device is compensated for by introducing non-symmetry in the folded loop antenna radiator pattern.

When a folded loop antenna is designed and integrated into a wireless device for use in Free space conditions, the antenna can be tuned in a such way that the E and H are creating the desired differential mode. However, when the same antenna is used in other use cases such as against the user's head, in the user's hand, surrounded by external objects such as tables, the E and H fields will be disturbed. For example, the antenna performance will be different when the device is against the user's left side of the head as compared to the right side of the head, due to the local environment of the antenna changing between these two use cases when the host device is mobile phone.

Additionally, with the advent of 4G technologies such as LTE (Long Term Evolution) entering service in the mobile wireless industry, there is a need for MIMO (Multiple Input Multiple Output) antenna systems in small mobile devices such as smart phones. For optimal MIMO performance the antenna efficiencies for the two antennas in a MIMO system should be equal. High isolation and low ECC (Envelope Correlation Coefficient) is also required for optimal MIMO antenna system operation, and isolation and ECC can be difficult to achieve in these small form factors. It is difficult to keep the efficiencies of two antennas in a small mobile device equal across the several use cases previously mentioned. The antennas can be designed to provide equivalent performance for a preferred use case, but the efficiencies of the two antennas will diverge as the local environment changes.

SUMMARY OF THE INVENTION

A passive folded loop antenna is disclosed. The passive folded loop antenna, when the device is positioned beside the head (BH) or in the hand (FH), the relative position of the signal feeding point and grounding point of the antenna radiator, compared to the head or hand is not identical whether you are using it as right handed or as left handed person. This difference of position leads to a different E and H field distribution around the antenna which creates a difference in performance between beside head Left (BHL) and beside head right (BHR) positions, which can be several dB.

For the same reason, performances differences can also be of several dB if the device is held in the right hand (FHR) or in the left hand. Leveraging on the almost symmetrical shape of the antenna radiator, the antennas herein provide an improved solution to limit the performance drop between the right or left side usage of the device.

In certain embodiments, an antenna structure comprises at least one folded loop antenna element, a radiator, which has at least two signal connection points, one at the first end of the antenna radiator and one at the other end of the antenna radiator, and one active component which can swap the connections between the antenna's radiator's two connection points and the feeding and grounding pads on the device's Printed Circuit Board (PCB).

Other features and advantages are described in the appended detailed description and claims.

DETAILED DESCRIPTION OF THE PREFERRED EMBODIMENTS

Figure 1A:
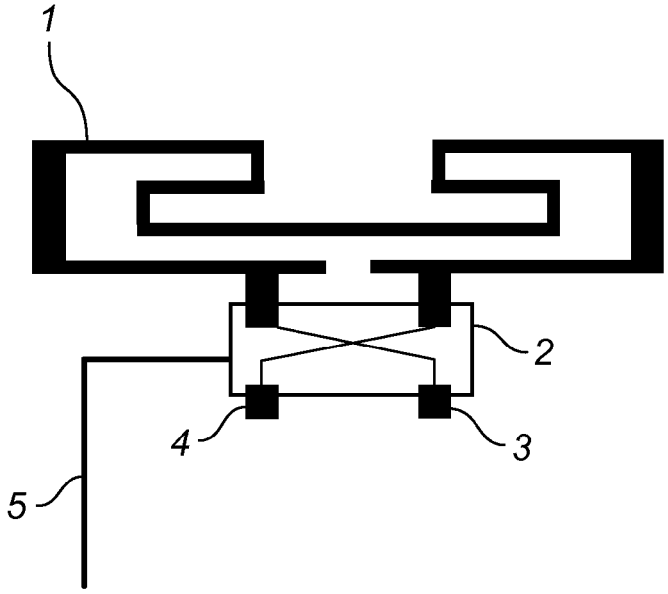
FIGS. 1(A-B) illustrate a loop antenna with swappable feed connection and ground connection.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

According to an example embodiment, the active swapping circuit can comprise transistors, diodes or Micro Electrical Mechanical System (MEMS) devices.

In another embodiment, the swapping circuit can have more than two inputs and two outputs and can offer a larger matrix of output connection for the radiator's connection points.

In another embodiment of the invention, a parasitic element can be coupled to a portion of the folded loop antenna. An active component can be connected to or coupled to the parasitic element, with this active component being used to alter the impedance loading on the parasitic element. By adjusting the impedance loading on the parasitic element the folded loop antenna can be tuned or compensated for to counteract the effects of loading on the loop antenna or the wireless device that the loop antenna is integrated in to. The swapping circuit can be used to determine which connection of the folded loop antenna is best for feeding the loop antenna; the parasitic element and active component can then be used to alter or fine tune the antenna element to compensate for loading effects. The active component can comprise an RF switch, tunable capacitor, MEMS switch or tunable capacitor, PIN diode, varactor diode, or tunable inductor.

In another embodiment of the invention, an active component can be connected to a portion of the folded loop radiator. This active component can be used to compensate for the effects of loading on the loop antenna or the wireless device the loop antenna is integrated in to. The active component can comprise an RF switch, tunable capacitor, MEMS switch or tunable capacitor, PIN diode, varactor diode, or tunable inductor.

In another embodiment of the invention, a pair of folded loop antennas can be used to comprise a MIMO antenna system. The pair of swappable feed circuits can be used to generate four combinations of feed configurations for the pair of antennas. An algorithm can be implemented in a processor on the host device, such as the baseband processor for example, wherein the four feed combinations can be sampled to determine which feed configuration provides the configuration for optimal isolation and/or ECC. As the loading on the host device changes, the antenna feed configuration can change to keep the pair of antennas optimized for MIMO system performance.

In another embodiment of the invention, two or more folded loop antennas can be connected to the same swapping circuit. Diplexers can be used to separate signals as a function of frequency and route the signals to the appropriate folded loop antenna. By adding additional diplexers, additional folded loops can be coupled to the same swapping circuit. The folded loop antennas can be nested or co-located to minimize volume required in the host device.

In yet another embodiment of the invention, a folded loop antenna with swapping circuit can be integrated into a host device such as a cell phone. A second larger loop antenna can be positioned in proximity to the first folded loop antenna with swapping circuit. The first folded loop antenna can act as a feed circuit for the larger loop antenna.

Figure 1B:
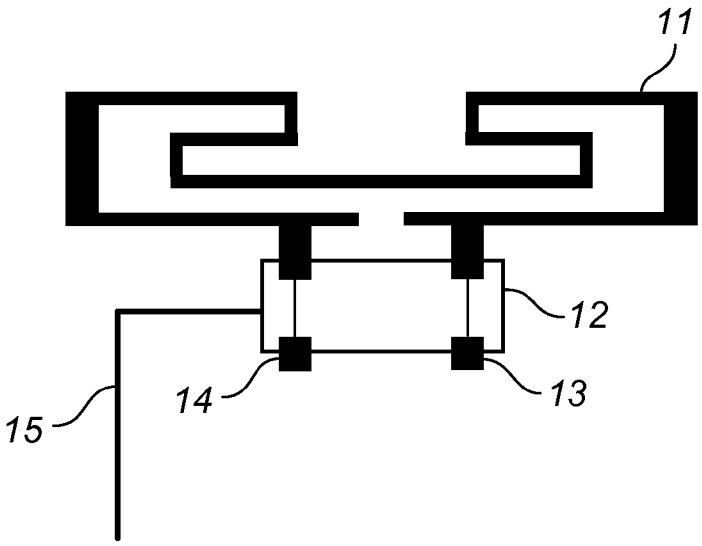

Now turning to the examples depicted in the drawings, FIG. 1 illustrates an example of a loop antenna 1 with swappable feed connection 3 and ground connection 4. A switch assembly 2 is used to change the feed and ground connections of the loop antenna 1 to an external transceiver or circuit. A control signal or signals 5 are provided to the switch assembly 2 to alter the feed and ground connections. "Antenna State 1" is shown in FIG. 1A, where ground connection 4 is connected to the right portion of the loop antenna 1, while feed connection 3 is connected to the left portion of loop antenna 1. "Antenna State 2", as illustrated in FIG. 1B, illustrates a loop antenna 11 where the ground connection 14 is connected to the left side of loop antenna 11 and the feed connection 13 is connected to the right portion of loop antenna 11. A control signal or signals 15 are provided to the switch assembly 12 to alter the feed and ground connections.

Figure 2:
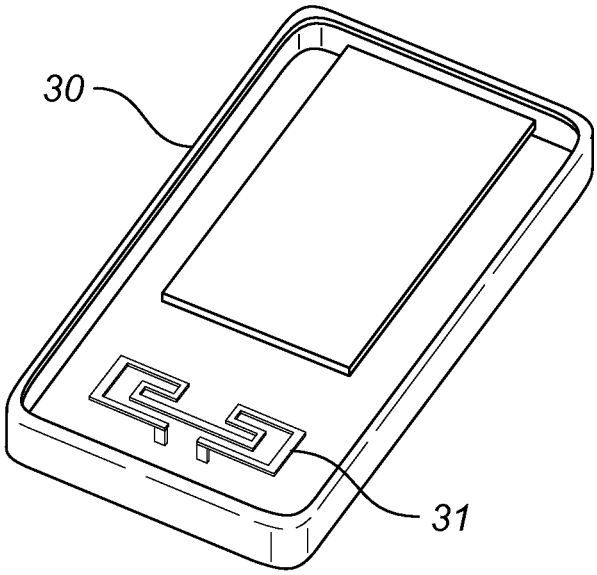
FIG. 2 illustrates a loop antenna integrated into a communication device.

FIG. 2 illustrates an example of a loop antenna 31 integrated into a communication device 30.

Figure 3A:
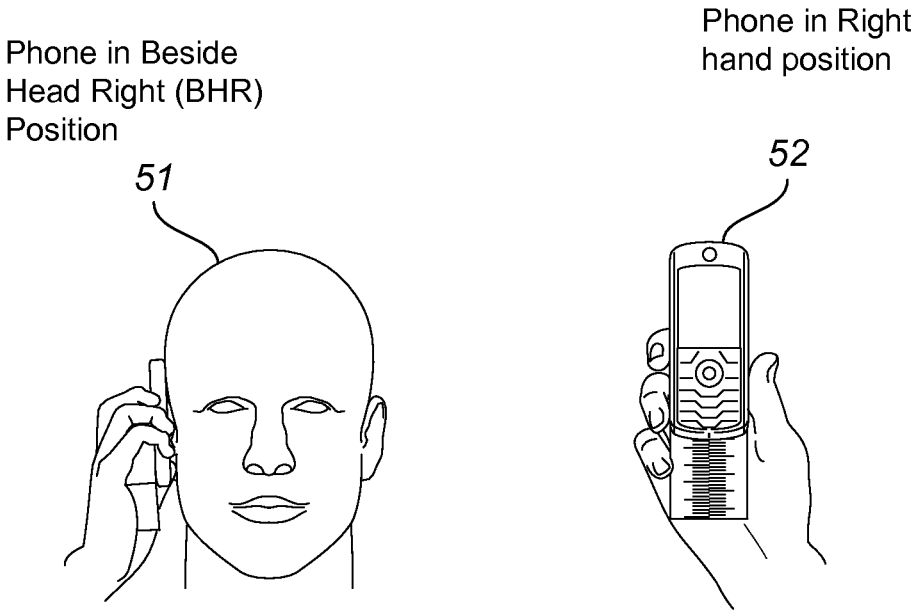
FIGS. 3(A-B) illustrate two typical use positions of a cell phone against a user's head, phone in head right position and phone in head left position.
Figure 3B:
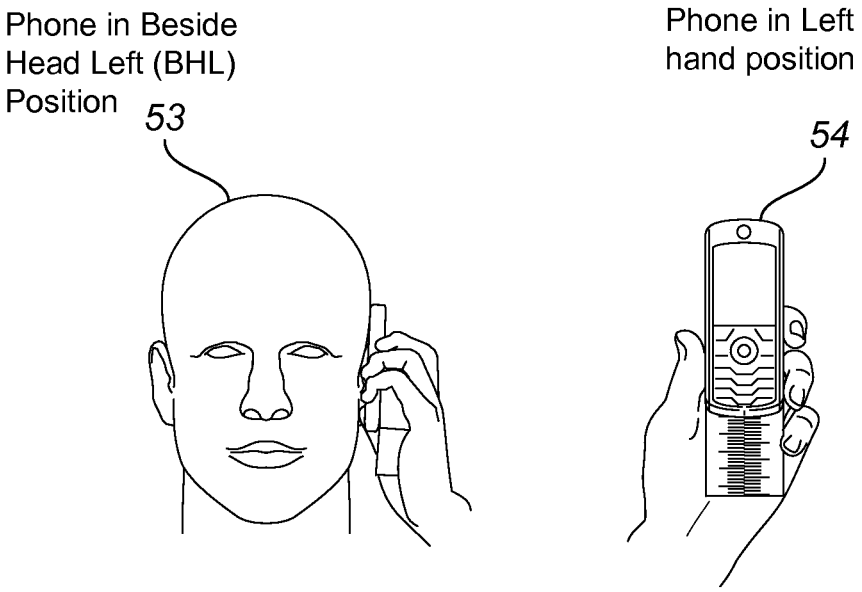

FIGS. 3(A-B) illustrate two typical use positions of a cell phone against a user's head, phone beside head right (BHR) position 51 and phone beside head left (BHL) position 53. Two primary hand positions for a phone are also illustrated, phone in right hand position 52 and phone in left hand position 54.

Figure 4:
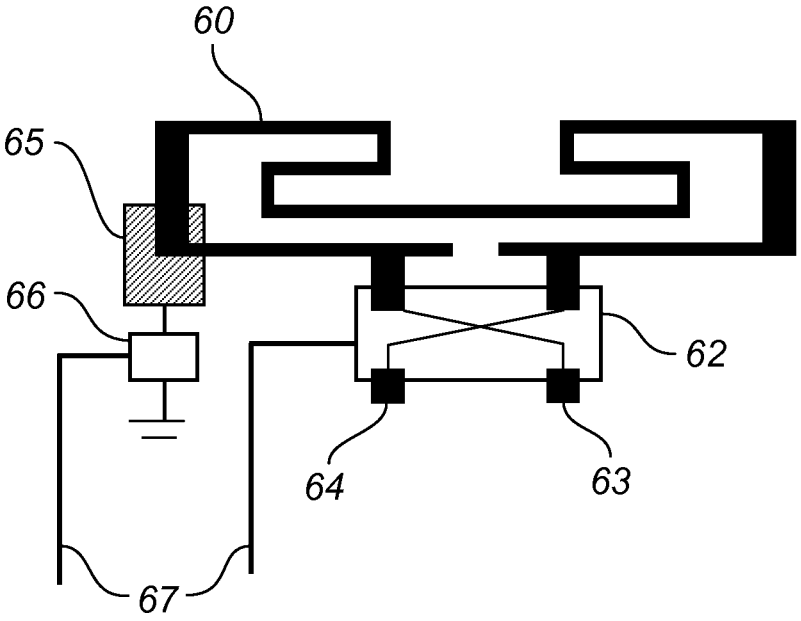
FIG. 4 illustrates a loop antenna connected to a switch assembly to provide the capability to alter feed connection and ground connection between the loop antenna and an external circuit.

FIG. 4 illustrates a loop antenna 60 connected to a switch assembly 62 to provide the capability to alter feed connection 63 and ground connection 64 between the loop antenna and an external circuit. A parasitic element 65 is positioned near the radiator and thereby coupled to a portion of loop antenna 60. The parasitic element is in turn coupled to an active component 66. Control signals 67 are provided to the active component 66 and the switch assembly 62.

Figure 5:
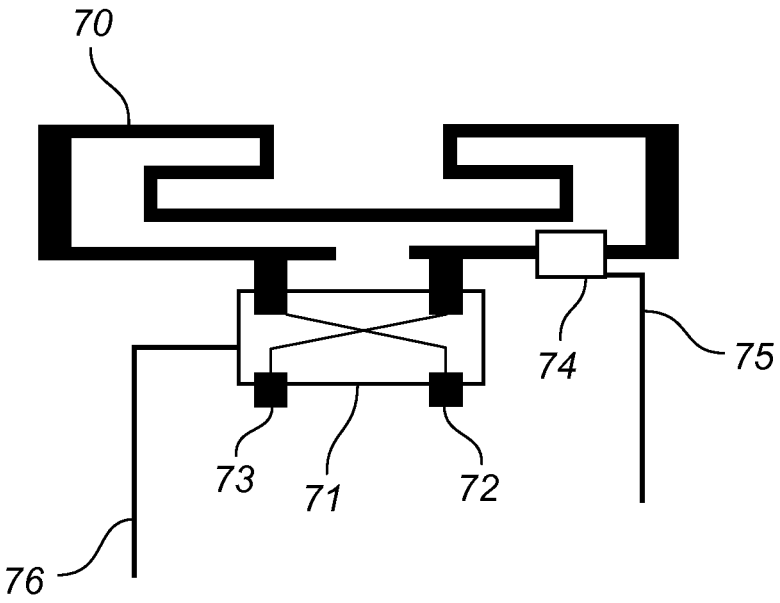
FIG. 5 illustrates a loop antenna connected to a switch assembly to provide the capability to alter feed connection and ground connection between the loop antenna and an external circuit.

FIG. 5 illustrates a loop antenna 70 connected to a switch assembly 71 to provide the capability to alter feed connection 72 and ground connection 73 between the loop antenna and an external circuit. An active component 74 is connected to a portion of the loop antenna. Control signal 75 is provided to the active component to alter the characteristics of the loop antenna. Control signal 76 is provided to the switch assembly to alter the feed and ground connections.

Figure 6:
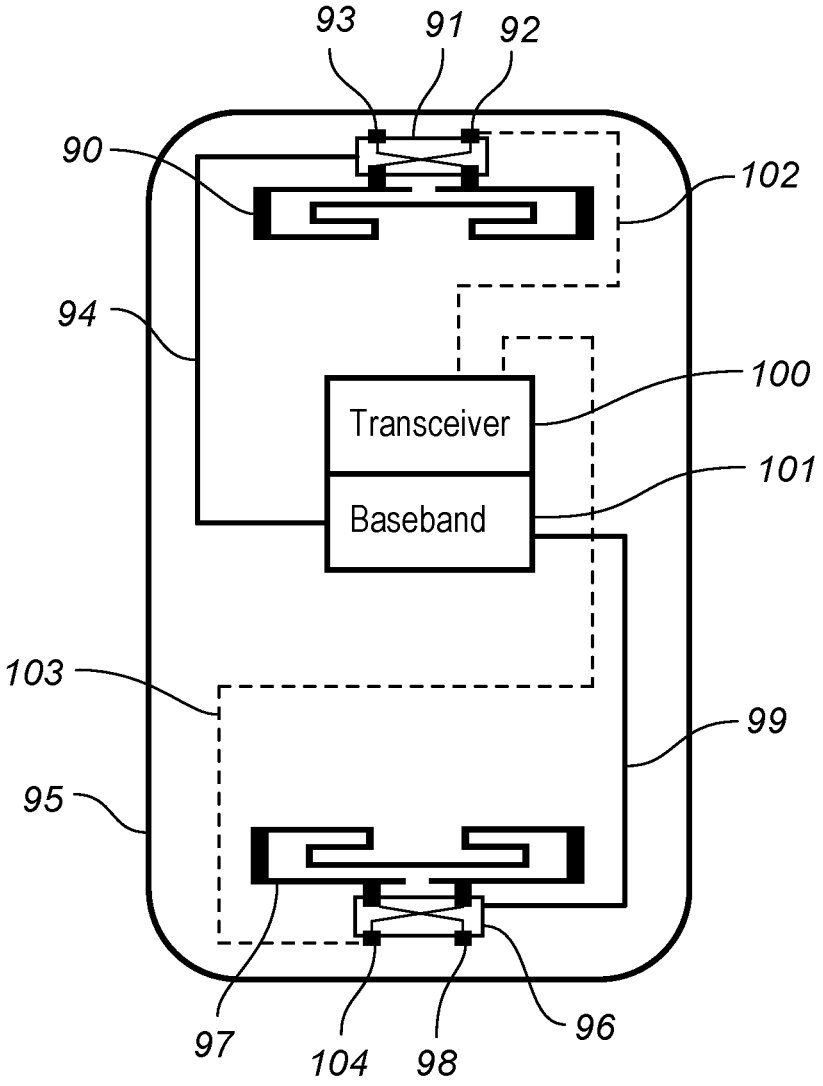
FIG. 6 illustrates a communication device 95 which contains two loop antennas according to one embodiment.

FIG. 6 illustrates a communication device 95 which contains two loop antennas 90 and 97. Loop antenna 90 is connected to switch assembly 91. Transmission line 102 connects transceiver 100 to feed connection 92. Control line 94 connects Baseband 101 to switch assembly 91. Loop antenna 97 is connected to switch assembly 96. Transmission line 103 connects transceiver 100 to feed connection 104. Control line 99 connects Baseband 101 to switch assembly 96. Control signals can be provided to both loop antennas simultaneously or serially to alter performance of the two antenna system.

Figure 7:
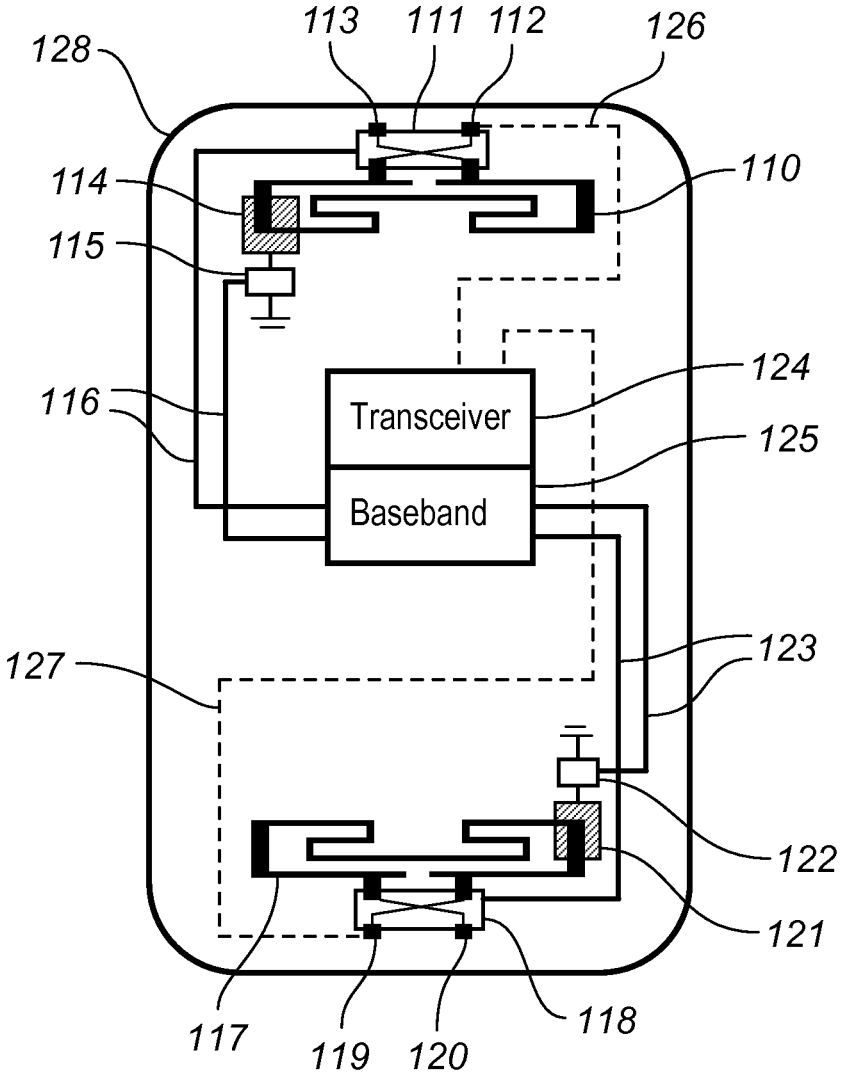
FIG. 7 illustrates a communication device 95 which contains two loop antennas according to another embodiment.

FIG. 7 illustrates a communication device 95 which contains two loop antennas 110 and 117. Each loop antenna contains a parasitic element and active component to adjust the antenna dynamically. Loop antenna 110 is connected to switch assembly 111. Transmission line 126 connects transceiver 124 to feed connection 112. Control line 116 connects Baseband 125 to switch assembly 111. Parasitic element 114 is coupled to loop antenna 110, and an active component 115 is connected to the parasitic element. A control line 116 from Baseband 125 is connected to the active component 115 to provide control signals to adjust the active component. A second loop antenna 117 is connected to switch assembly 118. Transmission line 127 connects transceiver 124 to feed connection 119. Control line 123 connects Baseband 125 to switch assembly 118. Parasitic element 121 is coupled to loop antenna 117, and an active component 122 is connected to the parasitic element. A control line 123 from Baseband 125 is connected to the active component 122 to provide control signals to adjust the active component.

Figure 8:
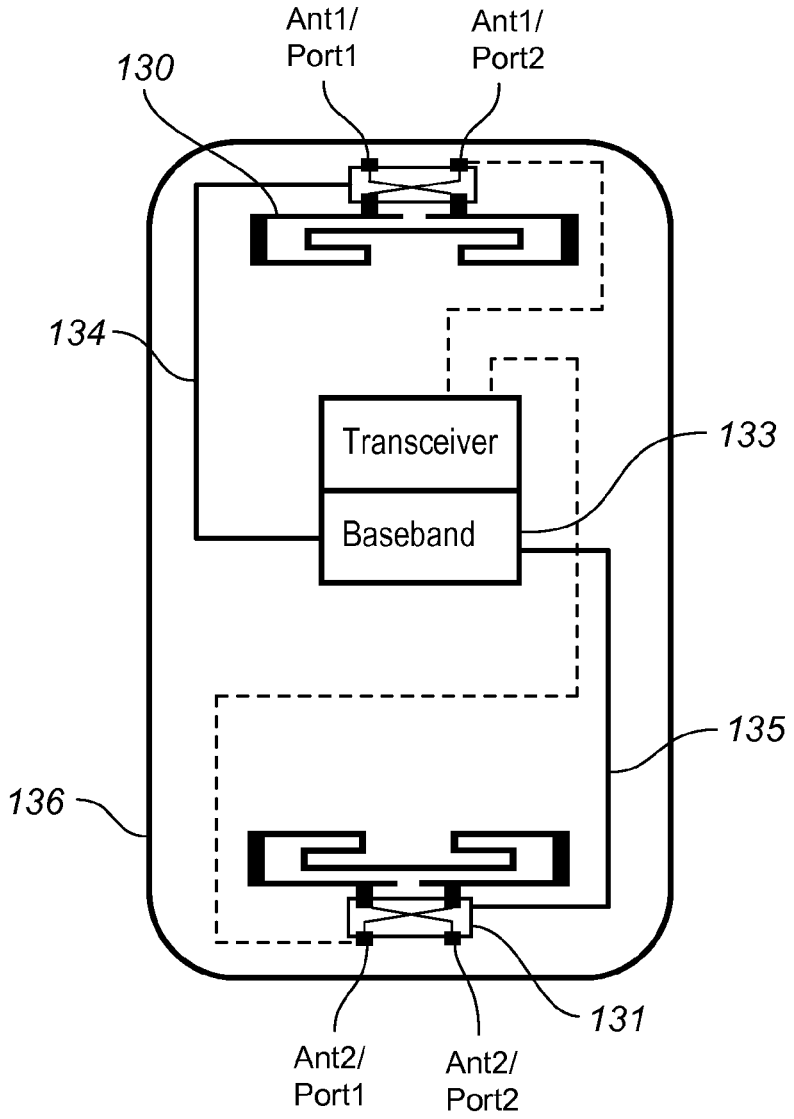
FIG. 8 illustrates a two antenna system that provides the capability to alter Envelope Correlation Coefficient (ECC) and/or isolation dynamically in accordance with one embodiment.

FIG. 8 illustrates a two antenna system that provides the capability to alter Envelope Correlation Coefficient (ECC) and/or isolation dynamically. Loop antenna assembly 130 which contains a loop antenna and switch assembly is positioned in a communication device 136. Loop antenna assembly 131 which contains a loop antenna and switch assembly is positioned at another location within the communication device 136. An algorithm is resident in Baseband processor 133 which selects between 4 tuning states which are represented in Table 132. Control lines 134 and 135 provide control signals to the loop antenna assemblies.

Figure 9:
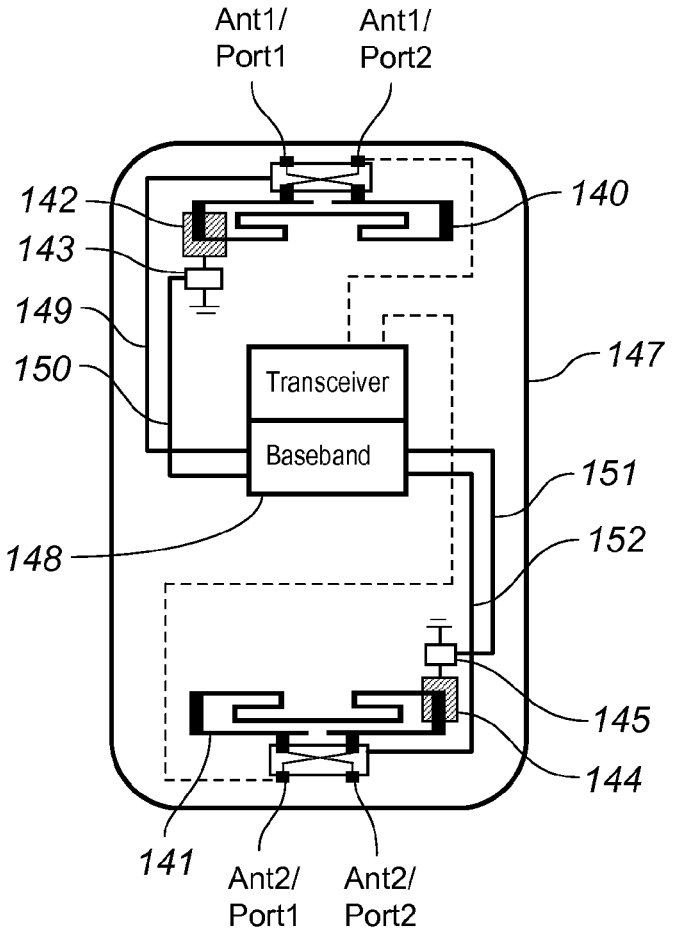
FIG. 9 illustrates a two antenna system that provides the capability to alter Envelope Correlation Coefficient (ECC) and/or isolation dynamically in accordance with another embodiment.

FIG. 9 illustrates a two antenna system that provides the capability to alter Envelope Correlation Coefficient (ECC) and/or isolation dynamically. Loop antenna assembly 140 which contains a loop antenna and switch assembly is positioned in a communication device 147. A parasitic element 142 is coupled to the loop antenna and an active component 143 is connected to the parasitic to alter the impedance loading on the parasitic. Control line 150 provides control signals from Baseband 148 to active component 143. Loop antenna assembly 141 which contains a loop antenna and switch assembly is positioned at another location within the communication device 147. A parasitic element 144 is coupled to the loop antenna and an active component 145 is connected to the parasitic to alter the impedance loading on the parasitic. Control line 151 provides control signals from Baseband 148 to active component 145. An algorithm is resident in Baseband processor 148 which selects between a plurality of tuning states which are represented in Table 146. Control lines 149 and 152 provide control signals to the loop antenna assemblies.

Figure 10A:
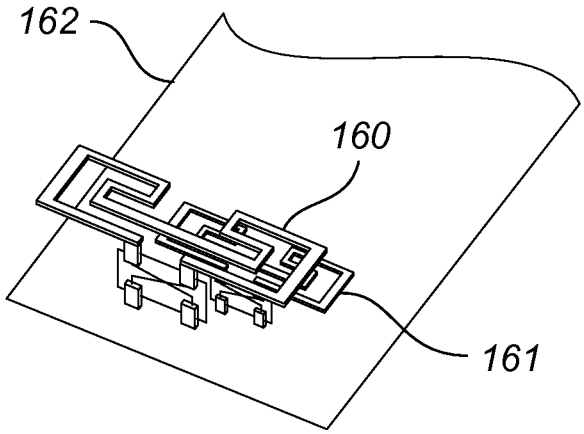
FIGS. 10(A-B) illustrate a two antenna system where the loop antennas are co-located or nested together.
Figure 10B:
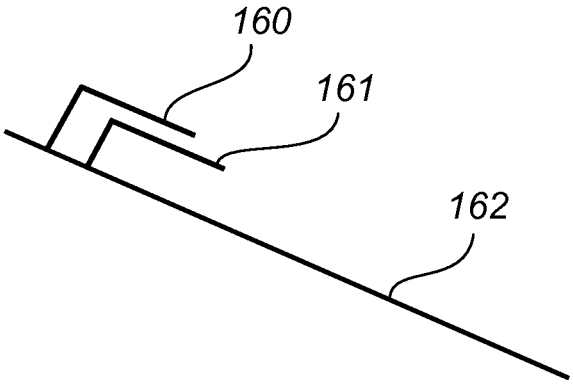

FIGS. 10(A-B) illustrate a two antenna system where the loop antennas are co-located or nested together. Loop antenna 160 is positioned on a ground plane 162. A second loop antenna 161 is positioned beneath loop antenna 160.

Figure 11:
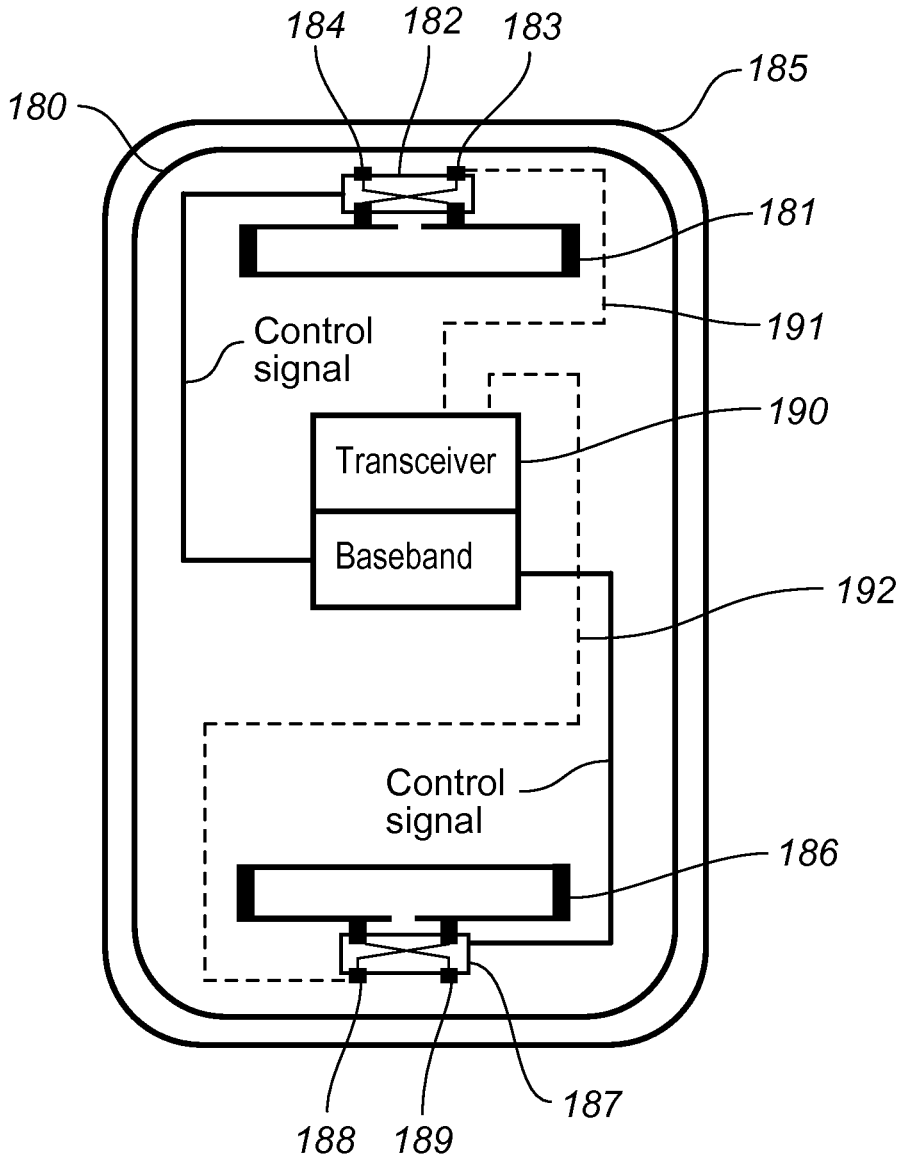
FIG. 11 illustrates a technique of coupling two loop antennas to a third, larger loop antenna.

FIG. 11 illustrates a technique of coupling two loop antennas to a third, larger loop antenna. Loop antenna 181 is positioned on one side of a communication device 185 and connected to switch assembly 182. A transceiver 190 is connected to port 183 of the switch assembly using a transmission line 191, with port 184 being the ground connection. Loop antenna 186 is positioned on the opposing side of a communication device 185 and connected to switch assembly 187. Transceiver 190 is connected to port 188 of the switch assembly using a transmission line 192, with port 189 being the ground connection. A third loop 180 is positioned in the vicinity of both loop antennas 181 and 186. One or both loop antennas 181 and 186 can couple a signal to loop 180 for use in transmitting a signal. Conversely, a received signal from loop 180 can be coupled to one or both loop antennas 181 and 186, with the received signal coupled into the transceiver 190.

Figure 12A:
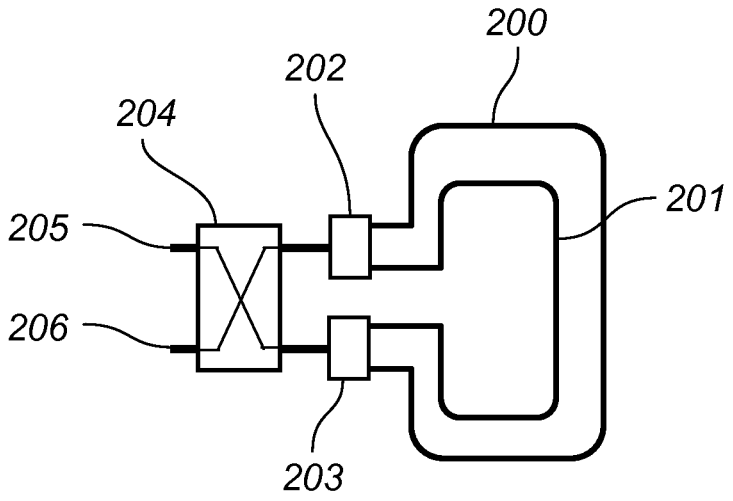
FIGS. 12(A-B) illustrate a technique of using a common switch assembly to feed two loop antennas.

FIG. 12*a* illustrates a technique of using a common switch assembly to feed two loop antennas. Switch assembly 204 is connected to diplexers 202 and 203. The two output ports of diplexer 202 are connected to one end of loop antenna 200 and loop antenna 201. The two output ports of diplexer 203 are connected to the opposing end of loop antenna 200 and loop antenna 201. A signal applied to port 205 or port 206 will transgress through switch assembly 204 and will be coupled to loop antenna 200 or loop antenna 201. The frequency characteristics of diplexer 202 and diplexer 203 will determine which frequencies are coupled to the two loop antennas.

Figure 12B:
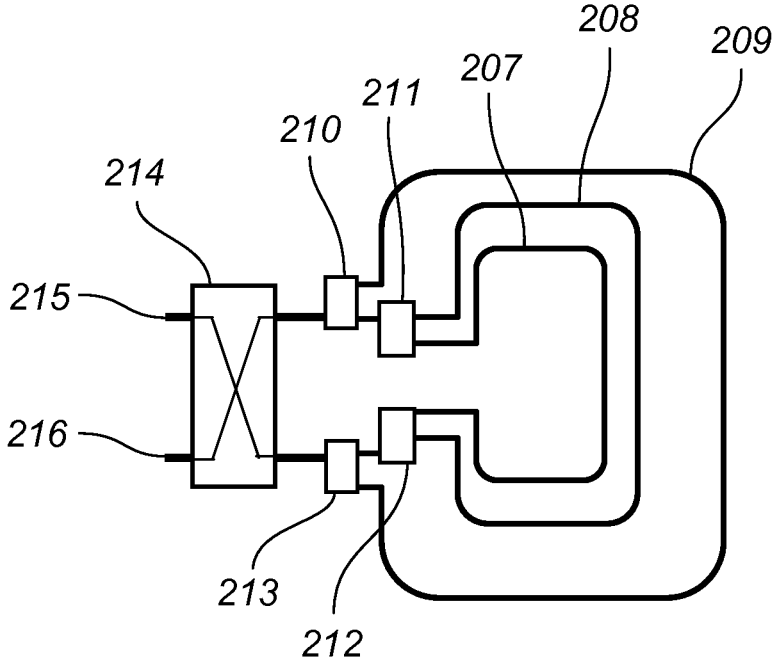

FIG. 12*b* illustrates a technique of using a common switch assembly to feed three loop antennas. Switch assembly 214 is connected to diplexers 207, 208, and 209. One output port of diplexer 210 is connected to one end of loop antenna 209 and the second output port of diplexer 210 is connected to diplexer 211. The two output ports of diplexer 211 are connected to one end of loop antennas 207 and 208. One output port of diplexer 213 is connected to the second end of loop antenna 209 and the second output port of diplexer 213 is connected to diplexer 212. The two output ports of diplexer 212 are connected to the second end of loop antennas 207 and 208. The frequency characteristics of diplexers 210, 211, 212, and 213 will determine which frequencies are coupled to the three loop antennas.

Figure 13A:
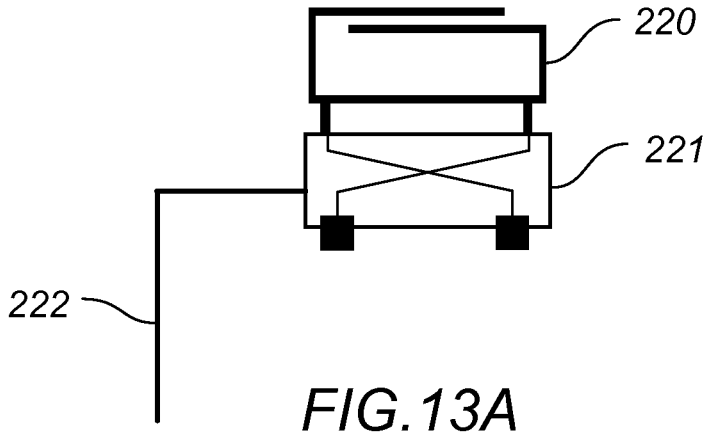
FIGS. 13(A-B) illustrate a swappable feed technique applied to an Isolated Magnetic Dipole (IMD) antenna.

FIG. 13*a* illustrates the swappable feed technique applied to an IMD (Isolated Magnetic Dipole) antenna. An IMD antenna 220 is connected to a switching assembly 221. A control line 222 is shown.

Figure 13B:
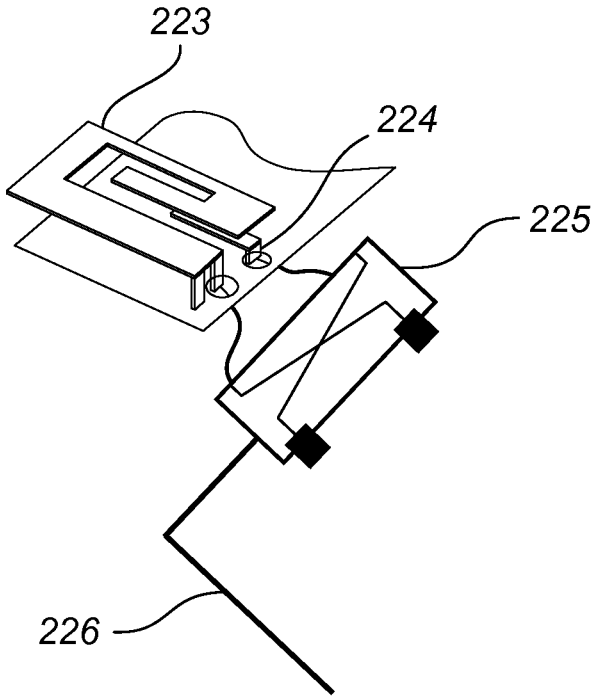

FIG. 13*b* illustrates another type of IMD antenna that can be used with a swappable feed assembly. IMD antenna 223 is positioned in proximity to a conductor 224. A switching assembly 225 is attached to the feed point of the IMD antenna 223 and the conductor 224. As control line 226 is shown.

Figure 14:
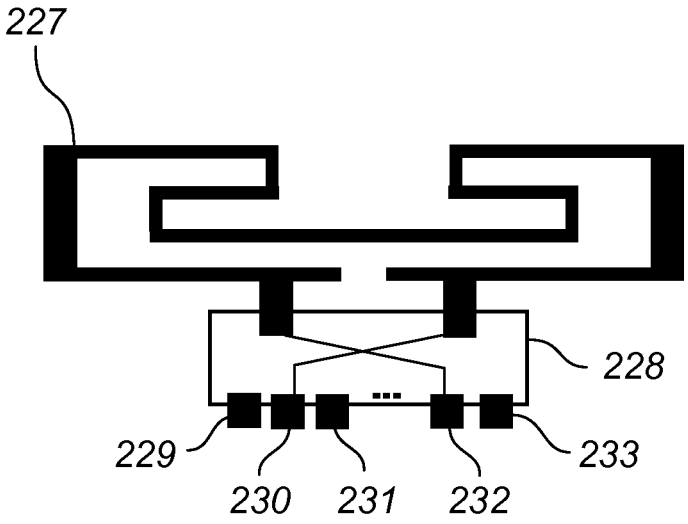
FIG. 14 illustrates a loop antenna with swappable feed connection and ground connection.

FIG. 14 illustrates an example of a loop antenna 227 with a swapping circuit 228 used to change the feed and ground connections of the loop antenna 228 to a selection of connection point, chosen among the possible output 229, 230, 231, 232, 233.

Figure 15:
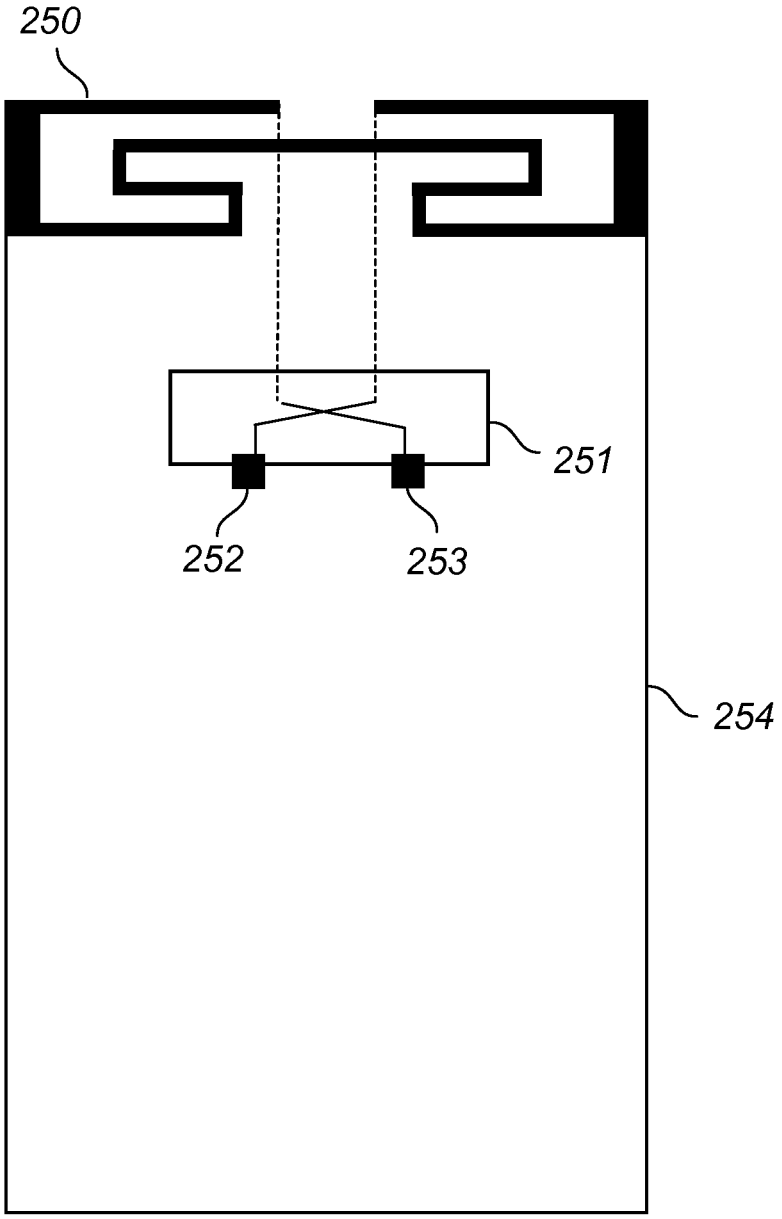
FIG. 15 illustrates a folded loop antenna structure wherein the loop antenna is formed on a circuit board of the device.

FIG. 15 illustrates a folded loop antenna structure wherein the loop antenna structure is formed by including part of the device (Cell Phone, Mp3 Player, Tablets) as part of the radiating structure. To control the differential mode generated by the loop, we can utilize the symmetrical nature of the device to form a symmetric loop with desired E and H Filed patterns. Using the swapping circuit to switch the feed and ground connections it will be possible to result in an efficient operating mode for different use cases (for example for switching between left hand to right hand in case of a cell phone).

Figure 16:
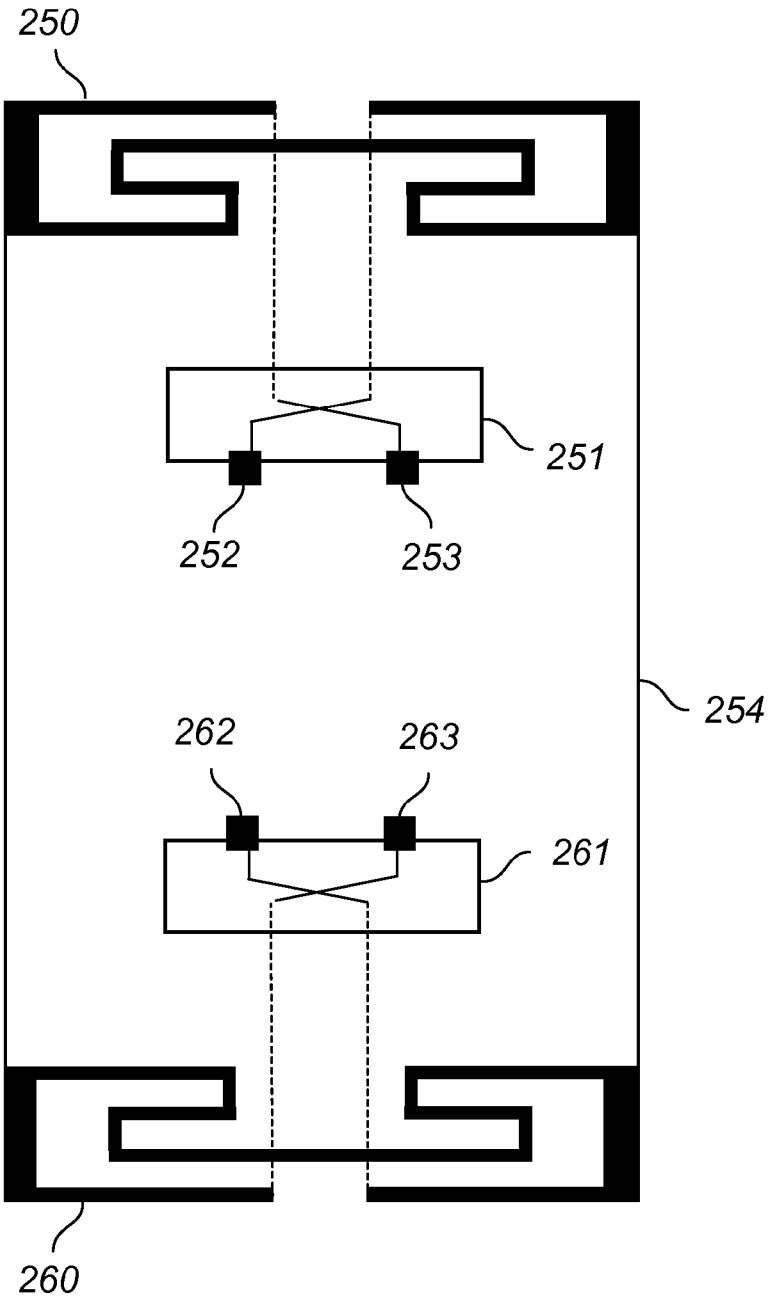
FIG. 16 illustrates two opposing loop antenna structures formed at each opposing end of a device circuit board.

FIG. 16 illustrates Two such folded loop antenna structures can be used in a MIMO configuration. The pair of swappable feeds can be used to generate 4 combinations of feeds for the two pair of antennas.

Figure 17:
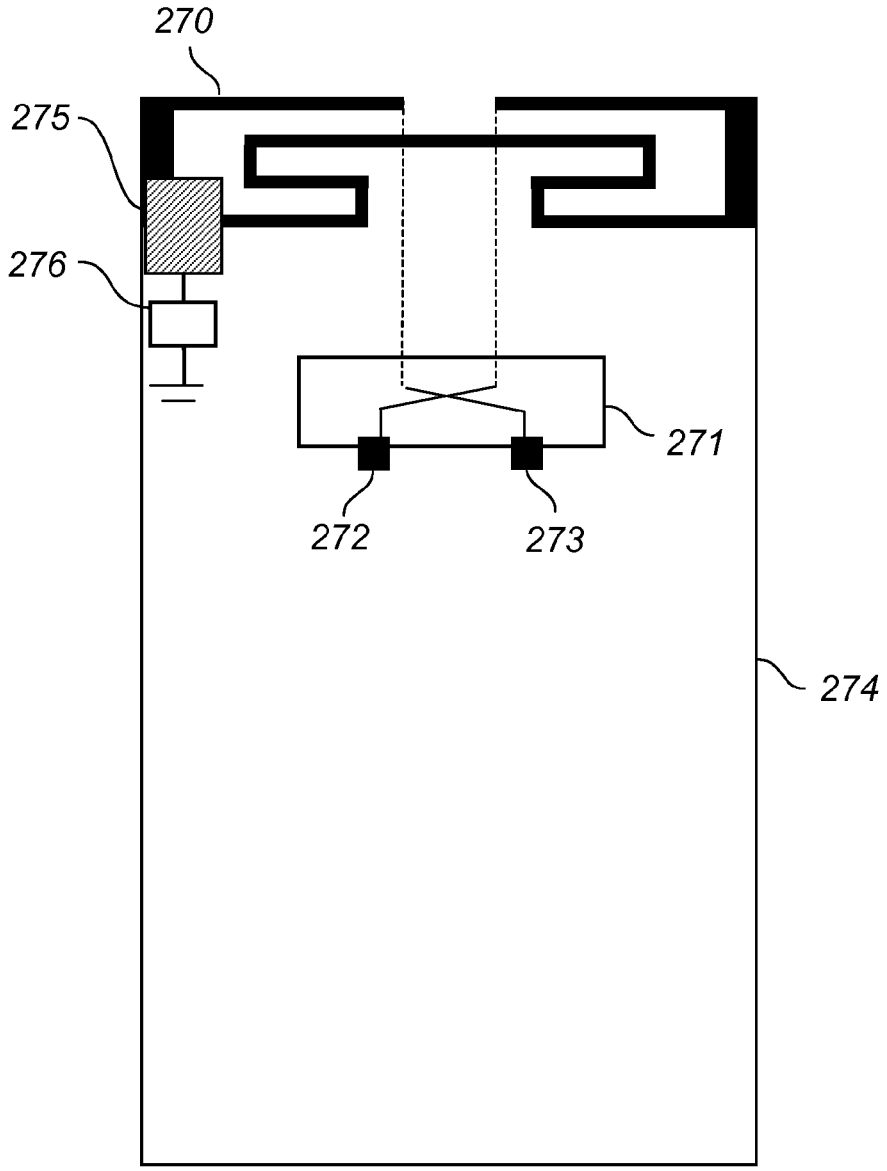
FIG. 17 illustrates the folded loop antenna formed about a device circuit board and comprising at least one parasitic element coupled to an active component for actively configuring the loop antenna.

FIG. 17 illustrates an embodiment where two symmetric parasitic elements (can be traces on PCB) that can be connected to active components (RF Switches, tunable capacitors, MEMS switches, PIN diode). The swapping circuit will help to generate equal efficiencies by utilizing a balanced (differential) mode generated by the loop antenna for different use cases (for ex. left hand and right hand). The differential mode is generated due to the symmetry of the folded loop structure. However with changes in the local environment in the proximity of the antenna, there is an impact on the E and H Field distribution in addition to the detuning of the antenna due to the different loading effects. The parasitic elements can be used to retune the antenna element for either combination of feeding structures. This will enable to control the match and also help with maintaining the required field distribution to generate the balanced mode.

The invention claimed is:

1. An antenna system for use with a wireless communication device, comprising:

a folded loop antenna including:

a first connection point disposed at a first end of the folded loop antenna, a second connection point disposed at a second end of the folded loop antenna opposite the first end, and at least one swapping circuit electrically connected to each of the first and second connection points of the folded loop antenna;

the swapping circuit comprising: a feed connection and a ground connection, each of the feed and ground connections of the swapping circuit being selectively configured to couple with one of the first and second connection points of the folded loop antenna, respectively;

characterized in that:

the swapping circuit is reconfigurable between at least two configurations, said at least two configurations including:

a first configuration, wherein:

a first RF path is configured to extend between the first connection point of the folded loop antenna and the feed connection of the swapping circuit, and a second RF path is configured to extend between the second connection point of the folded loop antenna and the ground connection of the swapping circuit; and a second configuration, wherein:

a third RF path is configured to extend between the second connection point of the folded loop antenna and the feed connection of the swapping circuit, and a fourth RF path is configured to extend between the first connection point of the folded loop antenna and the the ground connection of the swapping circuit;

wherein in each of the first and second configurations, the feed connection of the swapping circuit is configured to couple with an antenna feed signal and the ground connection is configured to couple with ground.

2. The antenna system of claim 1, wherein the swapping circuit comprises a: switch, diode, micro electrical mechanical systems (MEMS) device, tunable capacitor, or a combination thereof.

3. The antenna system of claim 1, wherein the swapping circuit comprises two or more feed connections for switchably connecting one of said feed connections to one of the first and second connection points of the folded loop antenna.

4. The antenna system of claim 1, wherein the swapping circuit comprises two or more ground connections for switchably connecting one of the two or more ground connections to one of the first and second connection points of the folded loop antenna.

5. The antenna system of claim 1, wherein a parasitic conductor is positioned in proximity to a portion of the folded loop antenna, a first port of an active component is connected to the parasitic conductor; a second port of the active component is connected to ground, the active component adapted to connect or disconnect the parasitic conductor to ground, and the frequency response of the folded loop antenna is altered as the active component is reconfigured between (i) an open state, wherein the active component is disconnected from the ground, and (ii) a shorted state, wherein the active component is connected to the ground.

6. The antenna system of claim 5, wherein the active component comprises a tunable capacitor, a micro electrical mechanical system (MEMS) device, a varactor diode, PIN diode, barium strontium titanate (BST) capacitor, or a phase shifter; wherein the active component is adapted to vary an impedance associated with the parasitic element for changing a frequency response of the folded loop antenna.

7. The antenna system of claim 5, said folded loop antenna, swapping circuit, parasitic conductor and active component defining a first antenna structure, the antenna system further comprising a second antenna structure including a second antenna, a second swapping circuit coupled to the second antenna, a second parasitic conductor positioned adjacent to the second antenna and a second active component associated with the second parasitic conductor; the first and second antenna structures combined to form a two-antenna multi-input multi-output (MIMO) antenna system, wherein each of the first and second antenna structures are connected to a two port transceiver.

8. The antenna system of claim 7, wherein the first and second antenna structures are configured to receive control signals communicated from a processor, wherein an algorithm is resident in the processor, said processor and algorithm adapted to alter the feed and ground connections of each connection point of one or both of the first and second antenna structures, wherein the algorithm is configured to implement a link quality metric selected from channel quality indicator (CQI), receive signal strength indicator (RSSI), throughput, or signal to interference plus noise ratio (SINR), to determine the feed and ground connections of the respective swapping circuits to be associated with each connection point of the first and second antenna structures.

9. The antenna system of claim 7, wherein the processor is further configured to control a signal communicated with each of the active components for reconfiguring each of the active components between (i) an open state, wherein the respective active component is disconnected from the ground, and (ii) a shorted state, wherein the respective active component is connected to the ground.

10. The antenna system of claim 5, wherein the active component comprises a switch.

11. The antenna system of claim 1, said folded loop antenna and swapping circuit defining a first antenna structure, the antenna system further comprising a second antenna structure including a second antenna and a second swapping circuit coupled therewith; the first and second antenna structures combined to form a two-antenna multi-input multi-output (MIMO) antenna system, wherein each of the first and second antenna structures are connected to a two port transceiver; the first and second antenna structures being configured to receive control signals communicated from a processor, wherein an algorithm is resident in the processor, said processor and algorithm adapted to alter the feed and ground connections of each connection point of one or both of the first and second antenna structures, wherein the algorithm is configured to implement a link quality metric selected from channel quality indicator (CQI), receive signal strength indicator (RSSI), throughput, or signal to interference plus noise ratio (SINR), to determine the feed and ground connections of the respective swapping circuits to be associated with each connection point of the first and second antenna structures.

* * * * *